US005581056A

United States Patent [19]

Bellgardt et al.

[11] Patent Number: 5,581,056

[45] Date of Patent: Dec. 3, 1996

[54] MUFFLER

[75] Inventors: Klaus Bellgardt; Stefan Jacobs, both of Edenkoben/Weinstr.; Gert Becker, Neustadt/Weinstr., all of Germany

[73] Assignee: Heinrich Gillet GmbH & Co. KG, Edenkoben/Weinstr., Germany

[21] Appl. No.: 375,750

[22] Filed: Jan. 20, 1995

[30] Foreign Application Priority Data

Jan. 20, 1994 [DE] Germany ..... 94 00 796.9 U

[51] Int. Cl.[6] ..... F01N 7/18

[52] U.S. Cl. ..... 181/282; 181/265

[58] Field of Search ..... 181/282, 243, 181/264, 265, 270

[56] References Cited

U.S. PATENT DOCUMENTS

| | | | |
|---|---|---|---|
| 4,132,286 | 1/1979 | Hasui et al. . | |
| 4,396,090 | 8/1983 | Wolfhugel . | |
| 4,415,059 | 11/1983 | Hayashi . | |
| 4,456,091 | 6/1984 | Blanchot | 181/282 |
| 4,865,154 | 9/1989 | Hanson et al. . | |
| 4,924,968 | 5/1990 | Moring, III et al. | 181/282 |
| 4,941,545 | 7/1990 | Wilcox et al. | 181/282 |
| 5,012,891 | 5/1991 | Macaluso . | |
| 5,280,142 | 1/1994 | Keller | 181/243 X |
| 5,332,873 | 7/1994 | Kullander et al. | 181/243 |

FOREIGN PATENT DOCUMENTS

| | | |
|---|---|---|
| 2228700 | 1/1974 | Germany . |
| 632013 | 1/1949 | United Kingdom . |
| 1012463 | 12/1965 | United Kingdom . |

*Primary Examiner*—Khanh Dang

*Attorney, Agent, or Firm*—Cohen, Pontani, Lieberman, Pavane

[57] ABSTRACT

A muffler having an inner shell of two deep-drawn inner sheet metal plates laid one atop the other and a housing shell of at least two deep-drawn outer sheet metal plates laid one atop the other. The inner shell has an encircling edge while the housing shell has an encircling housing flange with a lock seam connection which seals the housing shell. The edge of the inner shell is designed so that it barely touches the wall of the housing shell and is held in a spring-like fashion only between clamping creases of the housing shell.

12 Claims, 3 Drawing Sheets

MUFFLER

BACKGROUND OF THE INVENTION

1. Field of the Invention

The invention relates to mufflers with a deep-drawn inner shell and a deep-drawn housing shell.

2. Description of the Prior Art

In U.S. Pat. No. 4,396,090, an exhaust gas muffler is disclosed that has an inner shell consisting of two sheet metal plates laid one atop the other. The sheet metal plates of the inner shell are deep-drawn in such a manner that an S-shaped exhaust duct is created which is perforated at various locations. Furthermore, there is a housing shell, which likewise consists of two deep-drawn sheet metal plates laid one atop the other. The housing shell is placed onto the inner shell in such a manner that chambers are created between the inner shell and the housing shell. Finally, there is a partitioning wall of drawn sheet metal, which is clamped into the housing shell and holds the inner shell. The inner shell and the housing shell each have a flange, and the flanges are connected to one another in a gas-tight manner by a single welded seam.

In DE-A-22 28 700, a muffler is disclosed for opposed-cylinder engines arranged at the rear end of a vehicle. The housing consists of two deep-drawn shell halves with an encircling flange. A separating wall divides the housing interior into two chambers. The housing shell halves and the separating wall are connected by suitable connection means, e.g., by a welded seam. In order to allow exhaust gas to be conducted and sound to be muffled, the partitioning wall has openings as well as built-in and mounted parts which form absorption chambers, expansion chambers and reflection chambers as well as Venturi nozzles.

In U.S. Pat. Nos. 4,132,286; 4,415,059; 4,865,154; and 5,012,891, further mufflers are disclosed which consist of a deep-drawn inner shell and a deep-drawn housing shell which are laid one atop the other in such a manner that all four sheet metal plates can be connected to one another in a gas-tight manner with a single encircling welded seam in the area of the flanges. In the housing shell, deep and roughly V-shaped transverse folds are drawn, which touch the inner shell over the entire housing breadth and thus provide the same effect as the separate partitioning walls of the muffler previously described, albeit at twice the material expense.

In all of these mufflers, the flanges of the inner shell and those of the housing shell are connected to one another via a single, encircling weld seam, as mentioned. This can lead to mechanical problems, because the sheet metal plates of the inner shell, which are in direct contact with the hot engine exhaust gases, heat up and expand to a considerably greater extent than the sheet metal plates of the housing shell, which are externally cooled by the driving wind. Furthermore, a welded seam, due to the heating associated with it, leads to change in the microstructure of the sheet metal material, resulting under certain circumstances in intensified corrosion.

In GB-A-1 012 463, mufflers are disclosed with a deep-drawn inner shell and a deep-drawn housing shell, the flanges of which are connected to one another not in a material-bonded manner by means of welded seams, but rather in a positive-locking manner by means of a lock seam. In practice, however, lock-seam connections for four sheet metal plates laid one atop the other can be manufactured only at great expense, whereby the necessary impviousness entails additional difficulties. The described muffler also has a partitioning wall, for which purpose the sheet metal plates of the inner shell are cut out and bent accordingly.

Finally, GB-A-632 013 discloses a muffler with a deep-drawn inner shell and a deep-drawn housing shell, the flanges of which are laid one atop the other. The flange of the housing shell, however, is broader than that of the inner shell, so that upon mechanical connection by means of lock seam only the sheet metal plates of the housing shell are deformed. The flange of the inner shell is clamped between the non-deformed parts of the flange of the housing shell.

In the last-mentioned design, the flanges of the inner shell and the housing shell are not connected to one another in a non-detachable fashion across their full length, so that in purely theoretical terms the possibility exists of relieving thermal stresses between the inner shell and the housing shell. However, due to the large contact area between the two flanges, there are considerable holding forces at work and compensating movements can scarcely be expected. In addition, the gap which the clamped-in inner shell causes between the sheet metal plates of the outer shell leads to production and corrosion problems. The correct centering of the inner and outer shells is also problematic in this design, since given the closed housing a position check is no longer possible.

SUMMARY OF THE INVENTION

Accordingly, it is an object of the present invention to provide a muffler of the type mentioned above, in which the inner shell and the housing shell are able to carry out thermally-conditioned compensating movements, whereby at the same time manufacture of the muffler is made significantly simpler, quicker and less expensive.

Pursuant to this object, and others which will become apparent hereafter, one aspect of the present invention resides in a muffler having a first inner shell including at least two sheet metal plates arranged one atop the other, the inner plates being deep-drawn so as to define at least one gas-conducting duct and an edge that encircles the duct. A housing shell is provided which includes at least two outer sheet metal plates arranged one atop the other, the outer plates being deep-drawn so as to define two housing parts enclosing chambers, an inlet, an outlet and a flange that encircles the housing shell. The inner shell is arranged within the housing shell so that the edge of the inner shell touches the housing shell in a region of the housing shell flange. At least one partitioning wall is provided to hold the inner shell in the housing shell. Finally, pairs of clamping recesses are formed into the walls of the housing shell on both sides of the housing flange so that the clamping creases clamp the edge of the inner shell.

In the present invention, the flange of the inner shell extends only up to the housing shell. Here, use was made of the realization that a gas-tight connection between the inner shell and the housing shell is seldom necessary and that, as a rule, an acoustic seal is completely adequate. An acoustic seal is ensured in any case when the gaps between the flange of the inner shell and the inner wall of the housing shell are small enough. In this way, not only is material saved, but an attack by corrosion is prevented as well. For the flange connection of the housing shell, it is still necessary to deform only two sheet metal plates, which can be done with simple machines and tools. Because the inner shell is connected to the housing shell only at individual clamping points, the flange of the inner shell also no longer needs to be absolutely flat and smooth. Any drawing waves that might exist thus cause no problem. Furthermore, a balance of the thermal stresses can also be easily achieved. Different thicknesses in the sheet metal plate of the inner shell can be compensated for through appropriate minor changes in the clamping creases.

According to an advantageous further embodiment of the invention, the clamping creases of one housing shell part are at a greater distance from the plane of the housing flange than the clamping creases of the other housing shell part. In this way, the housing shell part with the shorter clamping creases acts as an adjustment aid for the exact positioning of the inner shell in the housing shell.

In a first variation of the invention, at least one partitioning wall is provided which has openings, particularly eyelets, for the ducts which conduct the exhaust gas. Piping connections which lengthen the ducts are formed on the inner shell and pass through the openings in the partitioning wall. Thanks to this design, a stable, self-holding built-in part is created after the housing shell is closed.

A second inner shell can also be provided, the ducts of which are likewise lengthened by piping connections. The piping connections of the second inner shell are inserted into the first piping connections.

If form creases have been formed into the piping connections, then during assembly these form creases position the partitioning wall, which can also be supported according to an advantageous further embodiment by a funnel-shaped extension of the piping connection ends. Furthermore, with the help of these form creases, locking of the piping connections inserted one within the other can be achieved.

This same advantage is also provided by the form creases when the exhaust ducts that lead further are not part of the shell with formed-on piping connections, but instead are conventional pipes.

According to a second variation of the invention, there is a partitioning wall that is divided into two parts. On each of the dividing surfaces of the wall at least one formed-on insertion tab is provided. The inner shell has corresponding insertion slots into which the tabs can be inserted.

As an alternative to this, holding tabs can be formed on the dividing surface and bent away at a right angle. For the purpose of attachment, sheet metal tabs are cut out of one of the sheet metal plates of the inner shell. The holding tabs are then clamped firmly between the second sheet metal plate of the inner shell and the sheet metal tabs. An advantage of this attachment is that no through opening is made in the inner shell. Of course, in order to improve stability and make assembly easier, the built-in parts can be connected to one another in a positive-locking and/or in a material-bonded manner.

Pursuant to a further embodiment of the invention the partitioning wall and the inner shell are connected to one another at least area-wise in a positive-locking and/or a material-bonded manner.

In still another embodiment the clamping creases of one housing shell part are at a smaller distance from the plane of the housing flange than the clamping creases of the other housing shell part.

In still yet another embodiment, the sheet metal plates of the inner shell have stiffening creases provided therein.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
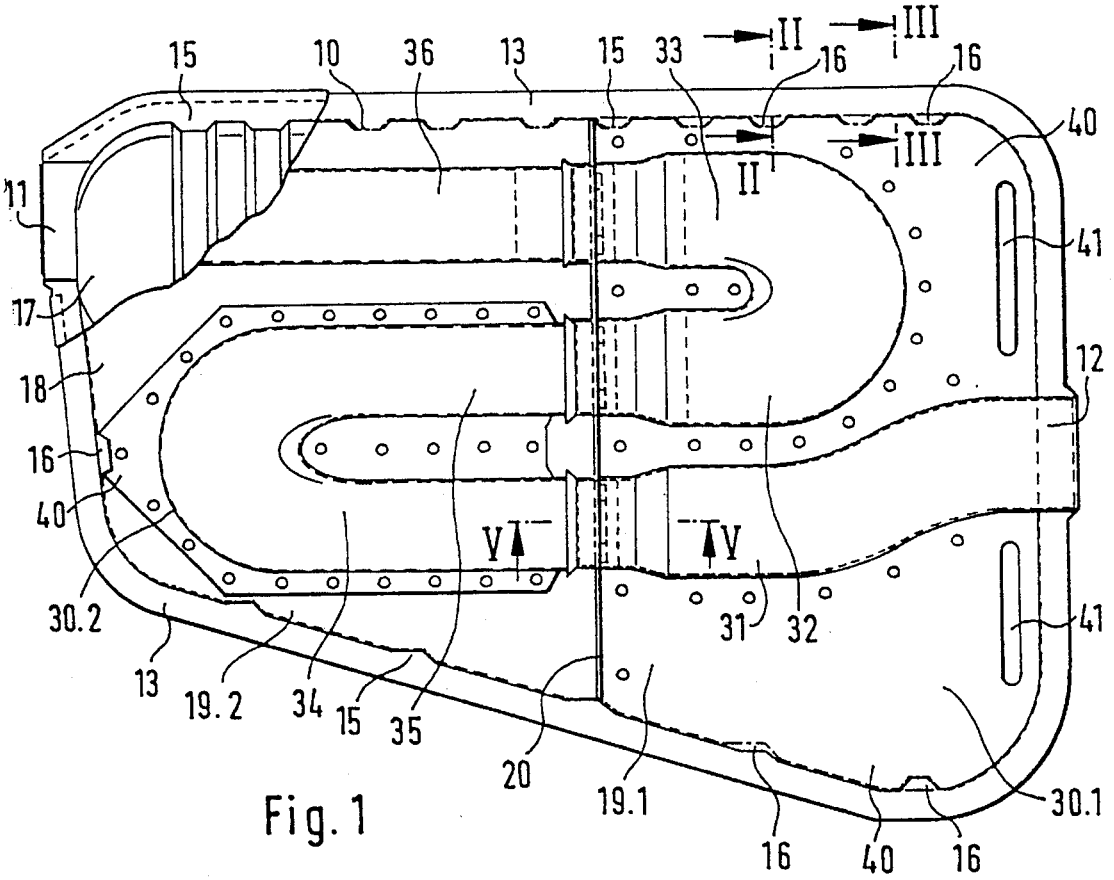
FIG. 1 is a partially broken-open view of a first embodiment of the inventive muffler with a deep-drawn housing shell, two deep-drawn inner shells and a one-part partitioning wall.

FIG. 1 shows a partially broken-open top view of a first embodiment of the inventive muffler. This drawing shows a housing shell 10 consisting of two deep-drawn sheet metal plates 17, 18 laid one atop the other, with an inlet connection piece 11 on one side and an outlet connection piece 12 on the other side. The housing shell encloses chambers 19.1, 19.2. The sheet metal plates 17, 18 of the housing shell 10 have creases 15 in order to reduce solid-borne sound emission. The housing shell 10 also has an encircling flange 13.

In the interior of the housing shell 10, there are two inner shells 30.1, 30.2 with an encircling edge or flange 40, each of which is produced from two sheet metal plates laid one atop the other. The sheet metal plates of the inner shells are deep-drawn in such a manner that gas ducts 31, 32, 33, 34, 35 are created, producing an S-shaped gas flow.

Finally, the drawing shows a conventional partitioning wall 20, which is placed into the housing shell 10 and holds the inner shells 30.1, 30.2.

As can be seen in FIG. 1, the edges 40 of the inner shells 30.1, 30.2 are designed so that they only touch the inner wall of the housing shell 10 in the area of the flange 13. The edges 40 are thus not clamped between the flange 13. This task is carried out by special clamping creases 16, which are formed more deeply, so that the edges 40 have a sufficiently large support surface.

The clamping creases 16 are located above and below the flange 13. The distance between each pair of clamping creases is coordinated precisely with the thickness of the sheet metal plates of the inner shell 30. However, the distances of the clamping creases 16 in the two housing parts to plane 1 of the flange 13 are not necessarily the same. As soon as the flange 13 of the housing shell 10 is tightly sealed in a material-bonded or, in particular, a positive-locking fashion, the clamping creases 16 press from above and from below onto the edges 40 of the inner shells 30.1, 30.2 and clamp the latter in place. The flange 13 thereby acts as a powerful spring.

Thanks to the point-type fixing in place of the inner shells 30.1, 30.2, relative movements are thoroughly possible, for example, due to differences in thermal expansion. Due to the point-type fixing in place, the flange 40 of the inner shells 30.1, 30.2 also does not need to be absolutely flat across its entire surface.

Stabilizing creases 41 in the edge 40 of the inner shells 30.1, 30.2 increase mechanical stability when the clamping creases 16 are located far apart from one another.

A special feature in the example shown in FIG. 1 is that the second inner shell 30.2 does not extend across the full breadth of the housing shell 10. Rather, a separate pipe 36 completes the exhaust path to the outlet connection piece 11. The concept according to the invention is also suitable for mufflers with conventional pipes.

Figure 2:
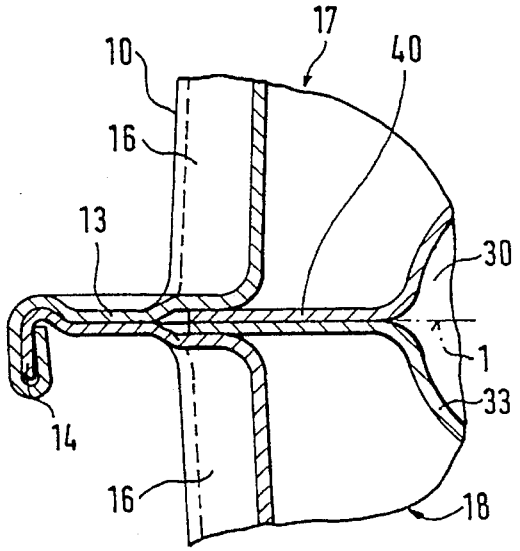
FIG. 2 is a partial section through the muffler in FIG. 1 along the Line II—II.

FIG. 2 shows the partial section II—II through the edge of the muffler in FIG. 1 in the area of a clamping crease 16. The edge 40 of the inner shell 30 is fixed in place in a spring-like fashion between an upper and a lower clamping crease 16. The flange 13 of the housing shell 10 shows no gaps or cavities in which condensate can form, and is sealed in a positive-locking manner by a lock seam 14.

Figure 3:
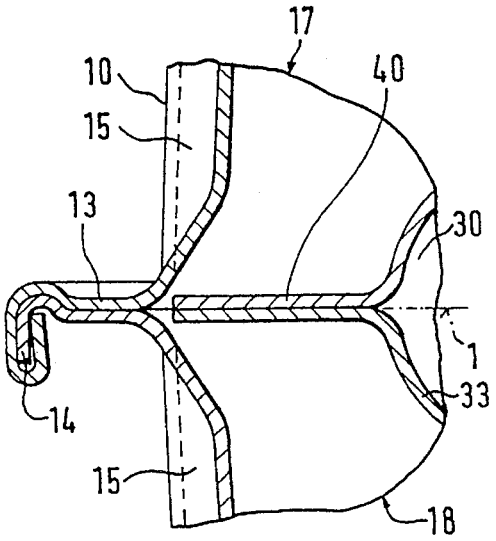
FIG. 3 is a partial section through the muffler in FIG. 1 along the Line III—III.

FIG. 3 shows the partial section III—III through the edge of the muffler in FIG. 1 in the area of a crease 15. The edge 40 of the inner shell 30 barely touches the housing shell 10 and the creases 15 are shaped so that they do not fix the edge 40 in place.

Figure 4:
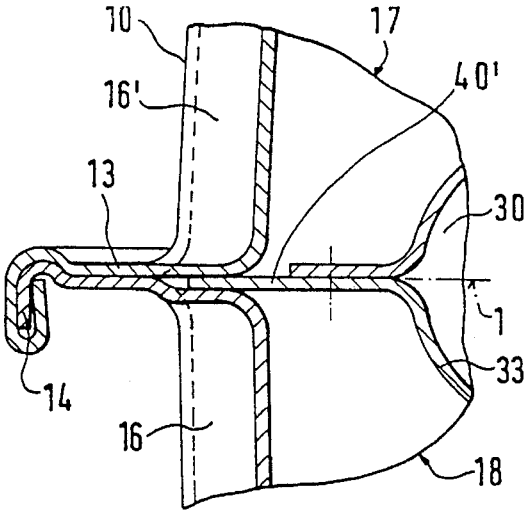
FIG. 4 is a partial section through a muffler of a modified design.

Next, an alternative design as illustrated in FIG. 4 will be described. By shortening the upper sheet metal plate of the inner shell 30, the edge 40' of the inner shell 30 is a single-layer in the area of the clamping creases 16, 16'. The crease 16' formed in the upper housing half 17 is therefore drawn down to the plane 1 of the flange 13. As soon as the inner shell 30 is laid onto the shorter clamping creases 16 of the lower housing halve 18, the edge 40' automatically centers itself to the lower housing half, permitting assembly to be carried out faster and more precisely.

The structure and assembly of the partitioning wall 20 and the inner shells 30.1, 30.2 are explained with reference to FIGS. 5, 6 and 7.

Figure 5:
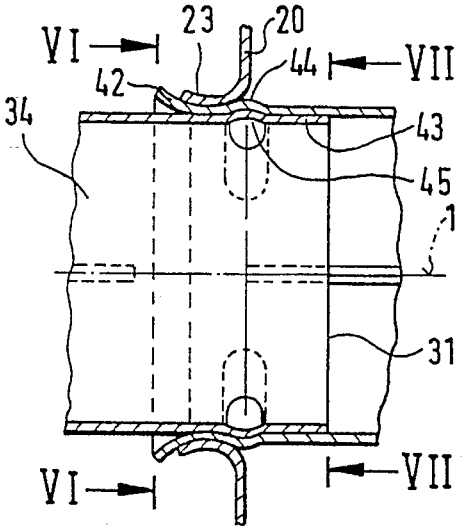
FIG. 5 is a partial section through the inner shell of the muffler in FIG. 1 along the Line V—V.

FIG. 5 shows the partial section V—V from FIG. 1 through the separating wall 20 and the inner shells 30.1, 30.2. This drawing shows one part of the partitioning wall 20, in which an opening 23 in the form of what is called an "eyelet" has been produced. Furthermore, the drawing shows, in cross-section, the end of the duct 31, which ends in a first piping connection 42. The first piping connection 42 is passed through the opening 23. The partitioning wall 20 is thereby held on one side by a lock seam 44 and on the other side by a funnel-shaped expansion of the end of the first piping connection 42. A second piping connection 43 with a form crease 45 is inserted and locked into the first piping connection 42. This second piping connection 43 is the end-side extension of the duct 34 in the second inner shell 31.2.

Figure 6:
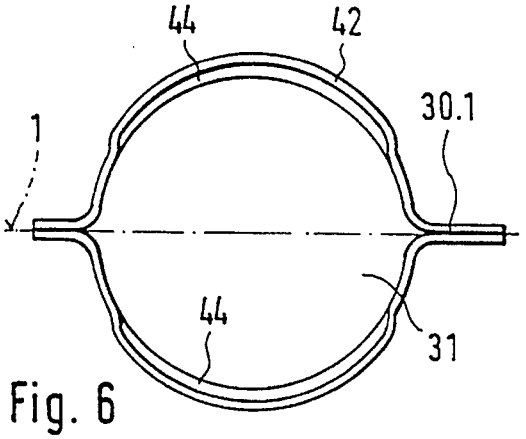
FIG. 6 is a section along the Line VI—VI in FIG. 5 though the first inner shell in the area of a duct end.
Figure 7:
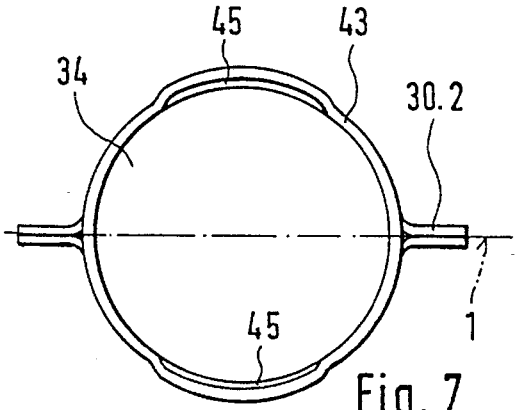
FIG. 7 is a section along the Line VII—VII in FIG. 5 through the second inner shell in the area of a duct end.

FIG. 6 shows the section along Line VI—VI of FIG. 5 through the first piping connection 42 and FIG. 7 shows a comparable section along Line VII—VII through the second piping connection 43. After the partitioning wall 20 and the first and second inner shells 30.1, 30.2 are joined, a sufficiently stable structure is created that can be placed into the housing shell 10. After the housing shell 10 is sealed, the result is a muffler with an S-shaped exhaust route and three chambers separated acoustically from one another, which can be used as needed as an absorption chamber, an expansion chamber or a resonance chamber.

Figure 8:
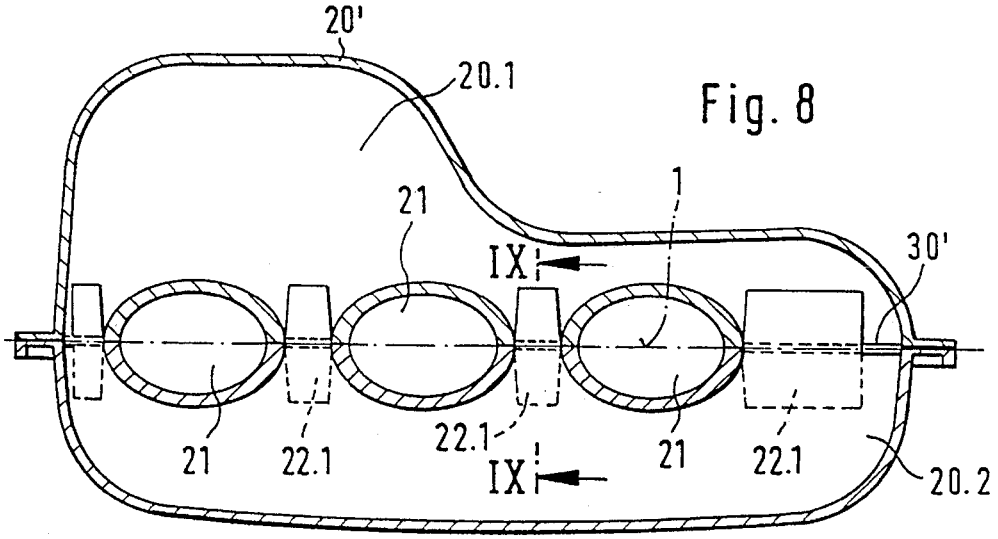
FIG. 8 is a cross-section through a second embodiment of the muffler with a deep-drawn housing shell, a deep-drawn one-part inner shell and a two-part partitioning wall.

FIG. 8 shows a cross-section through a second embodiment of an exhaust muffler. The housing shell 10 corresponds to that in FIG. 1. However, the inner shell 30' is a single part in this example, and the partitioning wall 20' is two-part. The drawing shows an upper and a lower partitioning wall part 20.1, 20.2. In the area of the separating line between the two partitioning wall parts 20.1, 20.2, there are three openings or eyelets 21 for the ducts 31, 32, 33 of the inner shell 30'. Furthermore, the drawing shows the insertion tabs 22.1, 22.2 between the openings 21. The inner shell 30' has insertion slots 46 corresponding to these insertion tabs 22.1, 22.2, into which the insertion tabs 22.1, 22.2 are inserted from above and below, respectively.

Figure 9:
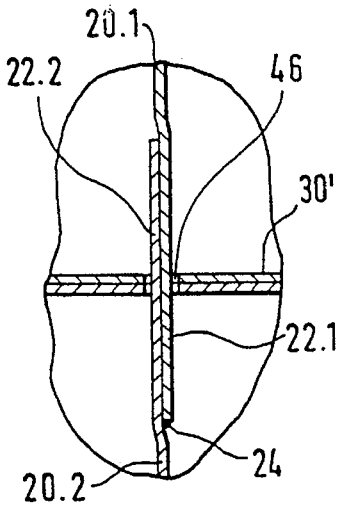
FIG. 9 is a partial section through the partitioning wall along the Line IX—IX in FIG. 8.
Figure 10:
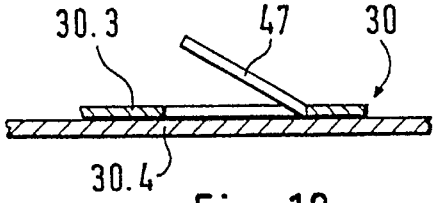
FIGS. 10 to 13 are cutout schematic illustrations of an alternative attachment of the partitioning walls to the inner shell.
Figure 11:
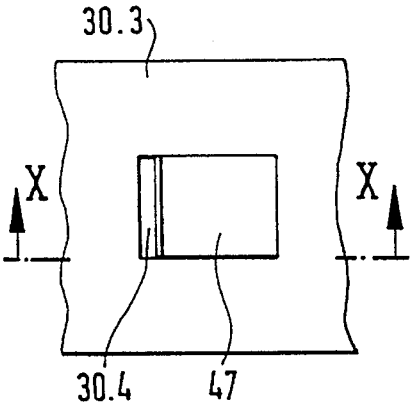
Figure 12:
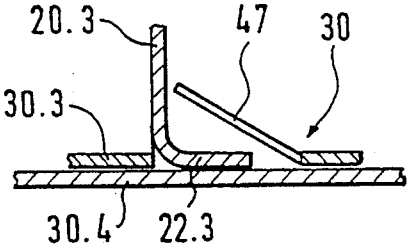
Figure 13:
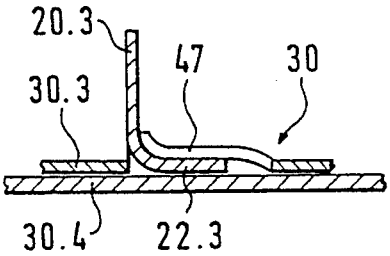

This situation is shown in FIG. 9, enlarged and in partial section. This drawing shows the inner shell 30' and the insertion slot 46, into which the tab 22.1 of the upper partitioning wall part 20.1 is inserted from above and the tab 22.2 of the lower partitioning wall part 20.2 is inserted from below. A welded seam 24 connects, as applicable, the two partitioning wall parts 20.1, 20.2 to one another and to the inner shell 30', making assembly easier and increasing stability.

FIGS. 10 to 13 show, in cross-section (FIGS. 10, 12, 13) and top view (FIG. 11), an alternative attachment method for a half partitioning wall 20.3. First, from one of the two sheet metal plates 30.3, 30.4, laid one atop the other, of the inner shell 30, a sheet metal tab 47 is cut out and bent slightly up. The half partitioning wall 20.3 has a holding tab 22.3, which is bent away at a right angle. This holding tab 22.3 is laid below the sheet metal tab 47. Subsequently, the sheet metal tab 47 is bent downward and the holding tab 22.3 is firmly anchored between the sheet metal plate 47 and the sheet metal plate 30.4 of the lower inner shell. In this attachment method, the inner shell 30 has no through opening, as is the case in the attachment methods in FIGS. 8 and 9.

Figure 14:
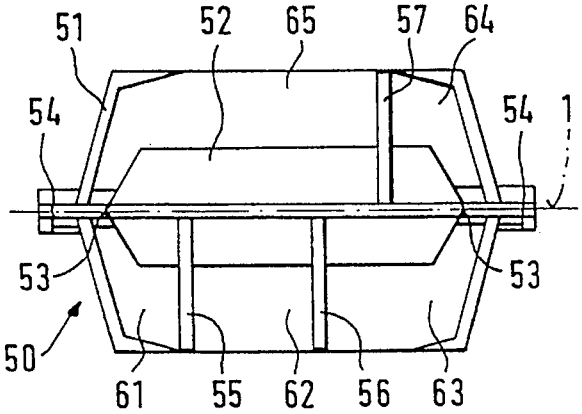
FIG. 14 is a longitudinal section through a third embodiment of the muffler with a deep-drawn housing shell, a deep-drawn inner shell and multiple partitioning walls.

FIG. 14 shows a longitudinal section through a third embodiment of the muffler 50 with a deep-drawn housing shell 51 and a deep-drawn inner shell 52, the encircling edge 53 of which is held in place by the holding creases in the housing shell 51. The housing shell 51 is again sealed by means of the encircling flange 54. Between the housing shell 51 and the inner shell 52 there are arranged three partitioning walls 55, 56, 57, so that the chambers 61, 62, 63, 64, 65 are created, which, depending on the application, can be used as expansion, reflection or absorption chambers or as Helmholtz resonators. The partitioning walls 55, 56, 57 are designed as half partitioning walls which are attached to the inner shell 52 with the help of the described holding brackets. Because the partitioning walls 55, 56 in the lower housing half no longer need to be aligned with the partitioning walls 57 in the upper housing half, the manufacturer of such a muffler has much greater freedom in the acoustic coordination than in conventional muffler designs.

The invention is not limited by the embodiments described above which are presented as examples only but can be modified in various ways within the scope of protection defined by the appended patent claims.

We claim:

1. A muffler comprising: a first inner shell including at least two inner sheet metal plates arranged one atop the other, the inner plates defining at least a gas-conducting duct and a peripheral flange; a housing shell including at least two outer sheet metal plates arranged one atop the other, the outer plates defining at least one chamber with opposed walls, an inlet, an outlet and a planar peripheral flange, the inner shell being arranged within the housing shell so that an outer edge of the flange of the inner shell contacts an interior of the housing shell in a region of the housing shell flange; at least one partitioning wall connected to the housing shell so as to hold the inner shell in the housing shell; and clamping creases correspondingly formed on the walls of the at least one chamber of the housing shell on opposite sides of the housing flange to form pairs of clamping creases configured to clamp the flange of the inner shell therebetween.

2. A muffler as defined in claim 1, wherein the at least one partitioning wall has openings therein, and further comprising first piping connections formed on the inner shell and being arranged in the openings in the partitioning wall.

3. A muffler as defined in claim 2, wherein the openings in the partitioning wall are formed as eyelets.

4. A muffler as defined in claim 2, and further comprising a second inner shell including at least two inner sheet metal plates arranged one atop the other to define at least one duct and a peripheral flange, the second inner shell being arranged within the housing shell adjacent to the first inner shell, and second piping connections formed on the second inner shell and inserted into the first piping connections to connect the duct of the second inner shell to the duct of the first inner shell.

5. A muffler as defined in claim 4, wherein the first piping connection has ends that are expanded in a funnel-shaped manner, the first and second piping connections having creases formed therein.

6. A muffler as defined in claim 1, wherein the at least one partitioning wall and the inner shell are connected to one another in a positive-locking manner.

7. A muffler as defined in claim 1, wherein the at least one partitioning wall and the inner shell are connected to one another in a material-bonded manner.

8. A muffler as defined in claim 1, wherein the at least one partitioning wall includes two parts, each of the parts of the partitioning wall having at least one insertion tab formed thereon, corresponding insertion slots being provided in the inner shell whereby the insertion tabs are inserted through the insertion slots.

9. A muffler as defined in claim 1, wherein the at least one partitioning wall includes two parts, each of the parts having at least one holding tab that is bent outwardly at approximately a right angle, at least one sheet metal tab being formed from one of the sheet metal plates of the inner shell whereby the holding tab is anchored under the sheet metal tab.

10. A muffler as defined in claim 1, wherein the clamping creases of a first one of the walls of the housing shell are arranged at a smaller distance to a plane of the housing shell flange than the clamping creases of a second one of the walls of the housing shell.

11. A muffler as defined in claim 1, wherein creases are provided in the sheet metal plates of the inner shell so as to stiffen the inner shell.

12. A muffler as defined in claim 1, wherein the at least two outer sheet metal plates of the housing shell include an upper plate and a lower plate, the at least one partitioning wall including a plurality of partitioning walls arranged in the housing shell, the partitioning walls being connected to the upper and lower plates of the housing shell so as to not be aligned.

* * * * *